US008664558B2

(12) United States Patent
Bose

(10) Patent No.: US 8,664,558 B2
(45) Date of Patent: Mar. 4, 2014

(54) HIGH-VOLTAGE POWER SWITCH WITH A SWITCH GAP

(75) Inventor: Shibani Bose, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 368 days.

(21) Appl. No.: 13/060,757

(22) PCT Filed: Aug. 11, 2009

(86) PCT No.: PCT/EP2009/060353
§ 371 (c)(1),
(2), (4) Date: Feb. 25, 2011

(87) PCT Pub. No.: WO2010/023095
PCT Pub. Date: Mar. 4, 2010

(65) Prior Publication Data

US 2011/0155695 A1 Jun. 30, 2011

(30) Foreign Application Priority Data

Aug. 25, 2008 (DE) ..... 10 2008 039 813

(51) Int. Cl.
*H01H 33/88* (2006.01)

(52) U.S. Cl.
USPC ..... 218/51; 218/53

(58) Field of Classification Search
USPC ..... 218/43, 51–68, 154–157
See application file for complete search history.

(56) References Cited

U.S. PATENT DOCUMENTS

| | | | | |
|---|---|---|---|---|
| 4,774,388 | A * | 9/1988 | Thuries et al. | 218/59 |
| 5,793,597 | A | 8/1998 | Mizufune et al. | |
| 5,978,200 | A | 11/1999 | Konma et al. | |
| 6,717,791 | B1 * | 4/2004 | Wiesinger | 361/123 |
| 7,402,771 | B2 | 7/2008 | Ye et al. | |
| 7,732,727 | B2 * | 6/2010 | Saxl et al. | 218/51 |
| 2003/0094436 | A1 | 5/2003 | Andou et al. | |
| 2007/0075044 | A1 | 4/2007 | Ye et al. | |
| 2007/0221626 | A1 | 9/2007 | Uchii | |
| 2010/0219161 | A1 * | 9/2010 | Seeger et al. | 218/51 |

FOREIGN PATENT DOCUMENTS

| | | | |
|---|---|---|---|
| CN | 1143257 | A | 2/1997 |
| CN | 19965382 | A | 5/2007 |
| EP | 0783173 | A1 | 7/1997 |
| EP | 1605485 | A1 | 12/2005 |
| JP | 11224576 | A | 8/1999 |
| WO | 9613844 | A1 | 5/1996 |
| WO | 2005122201 | A | 12/2005 |

OTHER PUBLICATIONS

German Search Report dated Jan. 21, 2009.

* cited by examiner

*Primary Examiner* — Amy Cohen Johnson
*Assistant Examiner* — Marina Fishman
(74) *Attorney, Agent, or Firm* — Laurence A. Greenberg; Ralph E. Locher

(57) ABSTRACT

A high-voltage power switch has a switch gap surrounded by a nozzle made of insulating material. The nozzle of insulating material is formed with a switching gas channel. The switching gas channel opens up into a storage volume. A flow steering apparatus is disposed within the storage volume. The flow steering apparatus has a switching gas entrance channel. An annular gap is formed between the wall in which the switching gas channel opens up and a switching gas entrance channel wall that borders the switching gas channel.

13 Claims, 4 Drawing Sheets

HIGH-VOLTAGE POWER SWITCH WITH A SWITCH GAP

BACKGROUND OF THE INVENTION

Field of the Invention

The invention relates to a high-voltage circuit breaker having a switching gap which is at least partially surrounded by an insulating material nozzle which has a switching gas channel which opens in a storage volume, and having a flow guide device, which is arranged at least partially within the storage volume.

By way of example, a high-voltage circuit breaker such as this is known from European Patent Application EP 0 783 173 A1, which describes a high-voltage circuit breaker which has a switching gap which is surrounded by an insulating material nozzle. The insulating material nozzle has a switching gas channel which opens in a storage volume. A flow guide device is arranged within the storage volume. The flow guide device has a valve, which opens and closes a recess as required. In this case, the flow guide device is arranged such that temporary storage of switching gas in the storage volume is controlled by the position of the valve there.

The known valve has a movable valve body which can be pressed over the recess, in a spring-loaded manner. If the circuit breaker is operated frequently, the valve is also operated frequently. Movable parts within the storage volume are subject to wear. Because of the design configuration of the storage volume, direct access, for example in order to carry out repairs, is not easily possible.

BRIEF SUMMARY OF THE INVENTION

The invention is therefore based on the object of specifying a circuit breaker of the type mentioned initially which has a robust configuration and can guide a switching gas flow with as little wear as possible.

According to the invention, this is achieved for a high-voltage circuit breaker of the type mentioned initially in that the flow guide device has a switching gas inlet channel which is bounded by a switching gas inlet channel wall and into which the switching gas channel injects switching gas in an emission direction, and a wall, in which the switching gas channel opens, and the switching gas inlet channel wall bounds an annular gap.

The use of a switching gas inlet channel in the flow guide device results in an advantageous flow within the storage volume while filling or emptying it. In this case, there is no need for any moving parts in the interior of the storage volume. The arrangement of an annular gap between the wall in which the switching gas channel opens and the switching gas inlet channel wall provides a capability to use a bypass to the switching gas inlet channel for switching gas guidance when particularly large volumes of switching gas occur suddenly. In normal conditions, a large proportion of the switching gas is passed on through the switching gas inlet channel in a section of the storage volume which faces away from the opening area of the switching gas channel of the insulating material nozzle. This makes it possible to provide sections which are of different gas temperatures within the storage volume. Switching gas which enters the storage volume is typically at a higher temperature than cold insulating gas which has not been directly involved in a switching process and has remained in the storage volume. If swirling of the cold insulating gas and of the hot switching gas is now restricted, it is possible to force preferably cool insulating gas or hot switching gas out of the storage volume as required.

When large amounts of switching gas are created during short time periods, it may, however, be necessary to introduce the large amounts of switching gas into the storage volume as quickly as possible. In this case, originally desired separation of cold insulating gas and hot switching gas is dispensed with and, for example, the annular gap between the switching gas channel inlet wall and the wall in which the switching gas channel opens is also used to pass the switching gas out of the switching gap as quickly as possible via all available means. This provides the capability to pass on heated switching gas, which has expanded in the switching gap, as quickly as possible, thus preventing an undesirable overpressure in the area of the switching gap.

Because of the choice of an annular gap, it is possible on the one hand to influence the flow in the interior of the storage volume, in order to make sections available in which cold insulating gas is swirled with hot switching gas only to a minor extent. On the other hand, the annular gap can reduce the risk of undesirable overpressures occurring in the area of the switching point.

A further advantageous refinement can provide for the switching gas inlet channel to be an annular channel.

High-voltage circuit breakers of a proven type typically have mutually coaxially opposite arc contact pieces and mutually coaxially opposite rated current contact pieces. In this case, the arc and rated current contact pieces are likewise arranged coaxially with respect to one another, thus creating a physical space between an arc contact piece and a rated current contact piece, in which, for example, a storage volume is located. The storage volume is preferably in the form of a hollow cylinder, in which case filling and emptying openings of the storage volume can preferably be arranged in end-face areas. The switching gas channel of the insulating material nozzle may, for example, be in the form of an annular channel in the area of its opening, with a substantially hollow-cylindrical cross section, with one of the arc contact pieces passing through it in at least one section. For this purpose, it is possible for an arc contact piece which projects into the switching gas channel to be shielded by an electrically insulating auxiliary nozzle, as a result of which the switching gas channel is in the form of an annular channel whose surfaces which bound it on the envelope side are formed from insulating material. A mouth opening of the switching gas channel in the storage volume in this case has an annular cross section. Since switching gas which is flooding through the switching gas channel extends virtually everywhere and uniformly within the switching gas channel because of the pressure conditions that result, it is advantageous for the switching gas inlet channel likewise to be in the form of an annular channel, in order to achieve a switching gas path with as little resistance as possible. In this case, at its inlet, that is to say on the side where the switching gas flows out of the switching gas channel in the switching gas inlet channel, the annular channel should have a cross-sectional area which corresponds to the mouth opening of the switching gas channel. The switching gas which flows into the storage volume out of the switching gas channel can thus flow into the flow guide device with little swirling, from where it is passed on.

In this case, the switching gas inlet channel advantageously has an inlet which is located upstream of an outlet in the emission direction, with the inlet having a smaller cross section than the outlet.

The flow resistance in the course of the switching gas inlet channel is reduced by the transition from a small cross section of the inlet to an enlarged cross section of the outlet of the switching gas inlet channel being as continuous as possible. This makes it possible, on the one hand, to reduce the flow velocity of the switching gas while it is actually passing through the switching gas inlet channel, because of the enlarged cross section. Furthermore, the pressure of the hot switching gas is reduced as it flows through the switching gas guide device. This on the one hand makes it possible for the switching gas to flow continuously through the switching gas inlet channel, while on the other hand allowing the heated switching gas passed on from the switching point to be calmed down at a relatively early time.

A further advantageous refinement allows at least one, and in particular a plurality of, reverse-flow channel or channels to be arranged in the switching gas inlet channel wall.

Reverse-flow channels in the switching gas inlet channel wall make it possible for hot switching gas which has first of all been passed on from the mouth opening of the switching gas channel to be deflected again, and passed back, into the area of the mouth opening. This makes it possible for cold insulating gas located in the storage volume to be deliberately forced out of the storage volume after the storage volume has been filled with hot switching gases, using the overpressure caused by the hot switching gas. The cold insulating gas should be driven like a stopper in front of the temporarily stored hot switching gas, which is now forced out again via the reverse-flow openings. In this case, the position and arrangement of the reverse-flow channels should result in as little mixing of cold insulating gas and hot switching gas as possible. Because of the use of an annular channel between the switching gas inlet channel wall and the wall in which the switching gas channel opens, it is possible to use the same switching gas channel in the insulating material nozzle as that used for filling the storage volume with hot switching gases, for the cold insulating gas to flow out of and be forced out of, followed by the hot switching gas as well. Guidance of the cold insulating gas and hot switching gas located within the storage volume is therefore organized within the storage volume in such a way that an insulating material nozzle of simplified design can be used, which has only one channel, which can be used for filling the storage volume with switching gas, and for emptying it. This allows the geometry of the insulating material nozzle to be simplified.

A further advantageous refinement allows at least one reverse-flow channel to pass through a switching gas inlet channel wall in the emission direction.

When at least one of the reverse-flow channels is arranged substantially parallel to the emission direction, this makes it possible to reverse the direction sense of a gas flow through 180° within the flow guide device. This makes it possible to extend the flow path of the switching gas within the storage volume in a relatively compact physical space. It is thus possible to reduce the total volume of the storage volume and to make available a sufficiently long path in the reduced physical space, along which the hot switching gas and cool insulating gas, which is driven by and is kept available within the storage volume, can flow.

A further advantageous refinement makes it possible for at least one reverse-flow channel to pass through a switching gas inlet channel wall radially with respect to the emission direction.

An arrangement of radially aligned reverse-flow channels makes it possible not only to use the switching gas channel to fill and empty the storage volume but also, after the storage volume has been filled with hot switching gas, to use the switching gas inlet channel to pass this hot switching gas, at least in places, via the switching gas inlet channel as well, in the direction of the mouth opening of the switching gas channel. In this case, the hot switching gas or else cold insulating gas can be introduced via the reverse-flow channels into the switching gas inlet channel, where it is guided in the opposite direction to the emission direction of the switching gas channel, and is introduced into it. The use of the switching gas inlet channel for gas guidance both for filling and for emptying the storage volume makes it possible to further reduce the physical space required for the storage volume.

Furthermore, it may also be advantageous for the switching gas inlet channel wall to have a projecting shoulder around the switching gas inlet channel.

A projecting shoulder makes it possible to provide an additional barrier within the storage volume, which additional barrier restricts switching gas and cold insulating gas from passing over in an undesirable manner, and from mixing to a major extent. In this case, it is advantageous for the projecting shoulder to be circumferential around the switching gas inlet channel. A circumferential form can be provided such that the shoulder extends in the radial direction and forms a barrier in the axial direction. However, it is also possible for the projecting shoulder to also extend in the axial direction, and to form a barrier which acts in the radial direction.

In this case, it may be advantageous for at least one reverse-flow channel to pass through the projecting shoulder.

In the case where corresponding reverse-flow channels are also provided within the projecting shoulder, it is possible to enlarge a cross section which is available for the reverse flow. Advantageous positioning of the reverse-flow channels also allows assisting guidance of the switching gas and of cool insulating gas. In this case, it is possible for reverse-flow channels to pass through the shoulder both in the radial and axial directions. In this case, it is advantageous, if the projecting shoulder has a radial extent, for the reverse-flow channels to pass through the projecting shoulder in the axial direction. If the projecting shoulder is aligned axially, it is advantageous for the reverse-flow channels to pass through a shoulder that has been integrally formed in this way, in the radial direction. It is, of course, also possible for the shoulder to have components which extend both in the axial direction and in the radial direction, and, depending on the requirement, for reverse-flow openings to be arranged both in the axial direction and in the radial direction in the shoulder.

It is also advantageously possible for a switching contact piece to project into the switching gas channel.

At least one switching contact piece can preferably pass through the switching gas channel in the insulating material nozzle. In this case, it is possible for the switching gas channel to be constricted at least at times by one of the switching contact pieces. However, it is also possible for one of the switching contact pieces to permanently project into the switching gas channel. For example, it is possible for a contact piece which projects permanently into the switching gas channel to be surrounded by a so-called auxiliary nozzle, in order to protect the contact piece which projects into the switching gas channel against hot switching gas. The switching gas channel is preferably designed to be rotationally symmetrical, in which case it may have different cross sections in the course of a path. If a switching contact piece, for example an arc contact piece, is arranged within the switching gas channel, then the cross section of the switching gas channel is reduced in this area, and the switching gas channel is in the form of an annular channel.

If a switching contact piece projects in, it is possible, in particular because of a constriction of the switching channel, to allow switching gas which has been heated and expanded in the switching gap to flow out in the preferred manner in one direction.

For example, it is possible by at least partially constricting the switching gas channel to force an adequate volume of hot switching gas into the storage volume and to allow it to flow through the flow guide device there in order in this way to make it possible to once again force cold insulating gas in the storage volume back into the switching gas channel.

It is advantageously also possible to form an annular gap between an outer envelope surface of the switching gas channel inlet wall and an inner envelope surface of the storage volume.

Provision of an annular gap between an inner envelope surface of the storage volume and an outer envelope surface of the switching gas channel inlet wall makes it possible to provide an overflow path in addition to the annular gap between the wall in which the switching gas channel opens and the switching gas channel inlet wall. In the event of increased pressures and/or increased volumes of hot switching gas, this can therefore also flow via and through the annular gap in addition to the switching gas inlet channel. During normal operation, the ratio of the flow resistances of the annular channels to the flow resistance of the flow inlet channel is, however, such that a preferred flow and guidance of the hot switching gases take place through the switching gas inlet channel. In the event of disturbances or particularly large volumes of switching gases, annular gaps can, however, provide additional flow paths in order to carry, to guide and to pass switching gases.

After the storage volume has been filled with hot switching gas, this gas can also flow away via an annular gap. The switching gas can flow into that section of the storage volume in which cold insulating gas is kept, via the annular gap formed between an outer envelope surface of the switching gas channel inlet wall and an inner envelope surface of the storage volume. This reduces swirling of hot switching gas and cold insulating gas. The cold switching gas can then flow into the switching gap via the switching channel.

It may be advantageous for the switching gas inlet channel wall to have a hollow truncated conical section, and for a reverse-flow channel to pass through the section.

A hollow truncated conical section of the switching gas inlet channel wall may be shaped to correspond to a widening switching gas inlet channel. On the one hand, a reducing flow resistance is made available along the path of the flow inlet channel, in the interior of the switching gas inlet channel. The positioning of the reverse-flow channel allows the flow inlet channel to also be used, at least in places, for emptying the storage volume. This allows direction changing and onward guidance of hot switching gases in an advantageous manner from the flow point of view within a compact storage volume, in a small physical space.

A further advantageous refinement allows the flow guide device to be kept at a distance from the walls of the storage volume via at least one stud bolt, which produces stressing forces running in the flow direction.

The fluid guide device can be fixed to a wall which bounds the storage volume, by means of at least one stud bolt. By way of example, an end-face wall for the storage volume offers a wall such as this. In this case, elongated bolts, for example threaded bolts, by means of which the flow guide device can be screwed to a wall of the storage volume, are suitable for use as stud bolts. In this case, the flow guide device should advantageously make contact with a wall of the storage volume exclusively via the stud bolt or bolts, such that the rest of the flow guide device is free of contact points with walls which bound the storage volume.

One exemplary embodiment of the invention will be described in more detail in the following text and is illustrated schematically in a drawing.

In the figures

DESCRIPTION OF THE INVENTION

Figure 1:
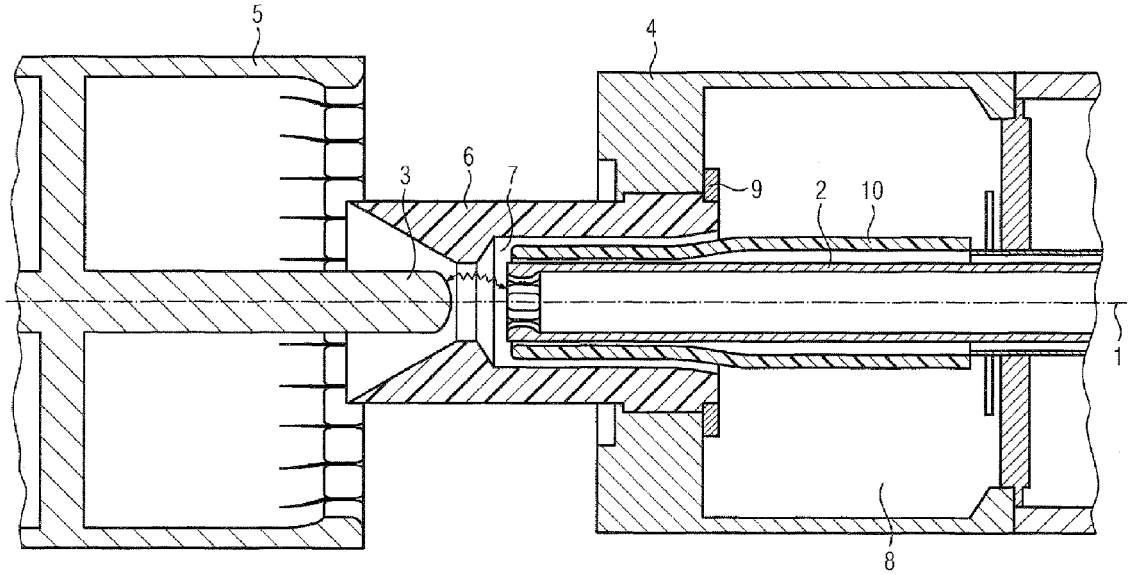
FIG. 1 shows a section view of a detail of an interrupter unit of a high-voltage circuit breaker, FIGS. 2, 3, 4, 5 each show a detail from FIG. 1, with various added embodiment variants of a flow guide device.

FIG. 1 shows a section view of a detail of an interrupter unit of a high-voltage circuit breaker. The interrupter unit of the high-voltage circuit breaker is formed substantially coaxially with respect to a longitudinal axis 1. The interrupter unit of the high-voltage circuit breaker has a first arc contact piece 2 and a second arc contact piece 3. The two arc contact pieces 2, 3 are aligned coaxially with respect to the longitudinal axis 1, and are arranged opposite one another. In this case, that end of the first arc contact piece 2 which faces the second arc contact piece 3 is equipped with a contact element which is in the form of a bush and has a plurality of contact fingers. The second arc contact piece 3 is in the form of a bolt, and is designed for insertion into the contact element, which is in the form of a bush, on the first arc contact piece 3.

A first rated current contact piece 4 is arranged coaxially with respect to the first arc contact piece 2. A second rated current contact piece 5 is arranged coaxially with respect to the second arc contact piece 3. The two rated current contact pieces 4, 5 each have a substantially hollow-cylindrical basic structure, with the first arc contact piece 2 and the first rated current contact piece 4 also being at the same potential when the high-voltage circuit breaker is in the open state, and with the second arc contact piece 3 and the second rated current contact piece 5 likewise also being at the same electrical potential when the high-voltage circuit breaker is open. At its end facing the first rated current contact piece 4, the second rated current contact piece 5 is provided with contact fingers which move onto an outer envelope surface of the first rated current contact piece 4 and can thus make an electrical contact between the two rated current contact pieces 4, 5. The arc contact pieces 2, 3 and the rated current contact pieces 4, 5 are in this case arranged with respect to one another such that, during a relative movement of the first arc contact piece 2 and the first rated current contact piece 4, as well as of the second arc contact piece 3 and the second rated current contact piece 5 during a connection process, the arc contact pieces 2, 3 make contact first of all, followed by contact then being made between the rated current contact pieces 4, 5. During a disconnection process, that is to say during a relative movement which causes the contact pieces 2, 3, 4, 5 to move away from one another, the two rated current contact pieces 4, 5 are electrically disconnected first of all, followed by electrical disconnection of the two arc contact pieces 2, 3. This ensures that any arcs which occur during a connection process or during a disconnection process preferably occur between the two arc contact pieces 2, 3 because of the respective leading and lagging of the arc contact pieces 2, 3. This makes it possible to manufacture the rated current contact pieces 4, 5 from a material which has a lower thermal resistance capability than the material which is used to form the contact areas of the two arc contact pieces 2, 3.

An insulating material nozzle 6 is arranged coaxially with respect to the longitudinal axis 1, in order to guide and conduct an arc which is struck between the arc contact pieces 2, 3. In this case, the insulating material nozzle 6 is arranged such that a switching gap between the two arc contact pieces 3 is arranged at least partially within a switching gas channel 7 which is bounded by the insulating material nozzle 6. The switching gas channel 7 has a constriction which is restricted at least at times by the second arc contact piece 3 during a switching process. The switching gas which has been heated and expanded by an arc that has been struck between the two arc contact pieces 2, 3 is thus preferably forced to move in the direction of a storage volume 8. The storage volume 8 extends coaxially with respect to the longitudinal axis 1 and has a substantially hollow-cylindrical shape. The insulating material nozzle 6 is fixed in one end face of the storage volume 8 by means of a bracing ring 9. The walls of the insulating material nozzle 6 which are adjacent to the storage volume 8, and/or the walls of the insulating material nozzle 6 which project into the storage volume 8, partially bound the storage volume 8. The first arc contact piece 2 passes through the storage volume 8, with the first arc contact piece 2 projecting into the switching gas channel 7, as far as the vicinity of the constriction. The first arc contact piece 2 is protected on the envelope side by a so-called auxiliary nozzle 10. The inward projection of the first arc contact piece 2 and of the auxiliary nozzle 10 results in the switching gas channel 7 being in the form of an annular channel at its end which projects in the direction of the storage volume.

During a disconnection process, the contact pieces 2, 4, 3, 5 move apart from one another. In the process, the rated current contact pieces 4, 5 are moved out of contact first of all. Shortly after this, the two arc contact pieces 2, 3 are electrically disconnected. An arc is struck between the two arc contact pieces 2, 3. The constriction is restricted by the second arc contact piece 3. A switching gas, which is heated and expanded by the thermal energy of the arc, can preferably flow away through the switching gas channel 7 in the direction of the storage volume 8, because of the restriction of the constriction, and it is temporarily stored there. An emission direction of the switching gas channel 7 is aligned substantially parallel to the longitudinal axis 1. The storage volume 8 contains an insulating gas which is cooler than the expanded switching gas. As the disconnection movement progresses, the constriction is released by the second arc contact piece 3 at a subsequent time, thus reducing the pressure in the switching gap. The switching gas which first of all enters the storage volume 8 is forced out via the switching gas channel 7, together with the cooler insulating gas which was previously located there, because of the overpressure produced in the storage volume 8 when it is being heated by the arc. In the process, the arc which is still burning between the arc contact pieces 2, 3 is cooled by the gas coming out of the storage volume 8, and it can be quenched at a current zero crossing. Restriking of the arc can often be prevented because of cooling and blowing of the arc, and the subsequent clearance of the switching gap of a plasma produced by the arc, by means of the gases emerging from the storage volume 8.

In order to make it possible to cope with relatively large arcs as well, it is necessary to provide deliberate guidance and influencing for the flow in the interior of the storage volume 8. FIGS. 2, 3, 4 and 5 show various refinement variants of a flow guide device, which are arranged in the interior of the storage volume 8. FIGS. 2, 3, 4 and 5 each show details of the interrupter unit, which is illustrated in outline form in FIG. 1, of a high-voltage circuit breaker.

Figure 2:
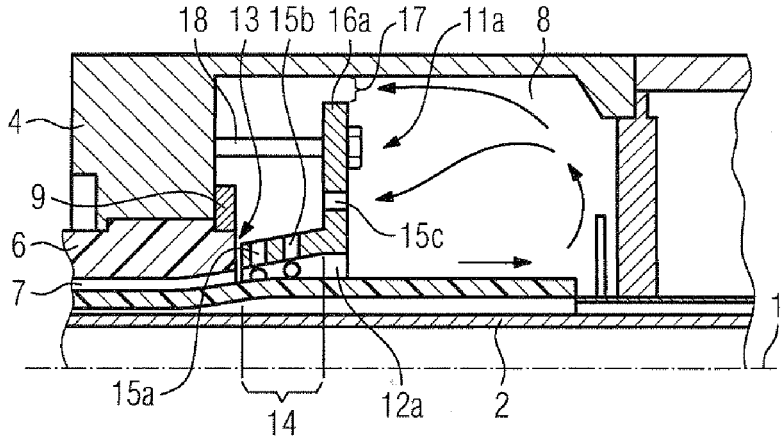

FIG. 2 shows a first refinement variant of a flow guide device 11*a*. The first refinement variant of a flow guide device 11*a* has a base body which is rotationally symmetrical with respect to the longitudinal axis 1. The flow guide device 11*a* is arranged at a distance from the wall in which the switching gas channel 7 opens. In the present case, this wall is formed by an end face of the insulating material nozzle 6. The first refinement variant of the flow guide device 11*a* has a switching gas inlet channel 12*a*. The switching gas inlet channel 12*a* in this case runs in the direction of the longitudinal axis 1, and has passing through it the auxiliary nozzle 10, which surrounds the first arc contact piece 2, and the first arc contact piece 2. The switching gas inlet channel 12*a* in the first variant of the flow guide device 11*a* therefore has a structure in the form of an annular channel. An annular gap 13 is formed between the mouth opening of the switching gas channel 7 in the storage volume 8 and a switching gas inlet channel wall of the first variant of the flow guide device 11*a*.

The first variant of the flow guide device 11*a* has a section 14 in which the flow inlet channel wall has a configuration which is substantially hollow cylindrical and in the form of a truncated cone, thus enlarging the cross section of the switching gas inlet channel 12*a* in the emission direction. A plurality of reverse-flow channels 15*a*, 15*b* are arranged in the section 14. In this case, the reverse-flow channels 15*a*, 15*b* are aligned substantially radially with respect to the longitudinal axis 1 and are arranged on two circumferential circular paths, as a result of which the section 14 has reverse-flow channels 15*a*, 15*b* distributed uniformly on its circumference. The switching gas inlet channel wall which bounds the switching gas inlet channel 12*a* has a substantially constant wall thickness within the section 14, with a projecting shoulder 16*a* being integrally formed in the area of the base surface of the hollow truncated conical section 14. The projecting shoulder 16 is in the form of a radially circumferential annular disk. The radially circumferential annular disk is in this case designed such that an annular gap 17 is formed on an outer envelope surface of the annular disk, and therefore on an outer envelope surface of the switching gas inlet channel wall. Furthermore, a reverse-flow channel 15*c* passes through the projecting shoulder 16*a*, passing through the flow guide device substantially in the emission direction of the switching gas channel 7. The emission direction corresponds substantially to the direction of the longitudinal axis 1. In this case, a plurality of reverse-flow channels 15*c* are arranged distributed on a circular path in the projecting shoulder 16*a*, thus resulting in the reverse-flow channels having an adequate cross section. Both the radial and the axially arranged reverse-flow channels 15*a*, 15*b*, 15*c* may, for example, have circular cross sections. However, it is also possible to provide reverse-flow channels with cross sections with curved shapes, which differ therefrom, for example in the form of slots.

When hot switching gas flows into the storage volume 8 from the switching gas channel 7, the switching gas is guided into the switching gas inlet channel 12*a*, in the emission direction of the switching gas channel 7. Because of the correspondence between the area of the mouth opening of the switching gas channel 7 and the opening of the inlet to the switching gas inlet channel 12, the switching gas passes through the annular gap 13 with little swirling. From the switching gas inlet channel 12*a*, the switching gas is passed on in a section of the storage volume 8 which faces away from the area of the opening of the switching gas channel 7. Protected by the switching gas guide device 11*a*, cold insulating gas is first of all separated from the hot switching gas flowing into the averted section of the storage volume 8. As the pressure within the storage volume 8 increases and the pressure in the switching gas channel 7 decreases, the hot switching gas flows out or overflows, for example, via the reverse-flow channels 15*a*, 15*b*, 15*c*, into the switching gas inlet channel 12*a*, and at least partially via this back into the switching gas channel 7. The switching gas channel 7 passes the gases which have been temporarily stored in the storage volume 8 back into the switching gap between the two arc contact pieces 2, 3. In addition to using the reverse-flow channels 15*a*, 15*b*, 15*c* for feeding back the gases, the annular gaps 17, 13 can also be used in order to feed switching gas and cool insulating gas out of the storage volume 8, and to allow them to flow away via the switching gas channel 7.

One or more stud bolts 18 is or are mounted in an end-face wall of the storage volume 8, in order to hold the switching gas guide device 11*a*. Corresponding screw connections to the first variant of the switching gas guide device 11*a* can be provided on the stud bolts 18. The switching gas guide device 11*a* splits off from the total volume of the storage volume 8 a section which extends radially behind a switching gas inlet channel wall. After the hot switching gases have been injected via the switching gas channel 7 and the switching gas inlet channel 12*a*, cold insulating gas which is kept in the section can be protected against major mixing with hot switching gases as they enter. When the hot switching gas flows back, for example via the reverse-flow channels 15*a*, 15*b*, 15*c* and the annular gaps 13, 17, the cold insulating gas is driven in front of the hot switching gas, and is ejected from the storage volume 8 in front of the hot switching gas.

Figure 3:
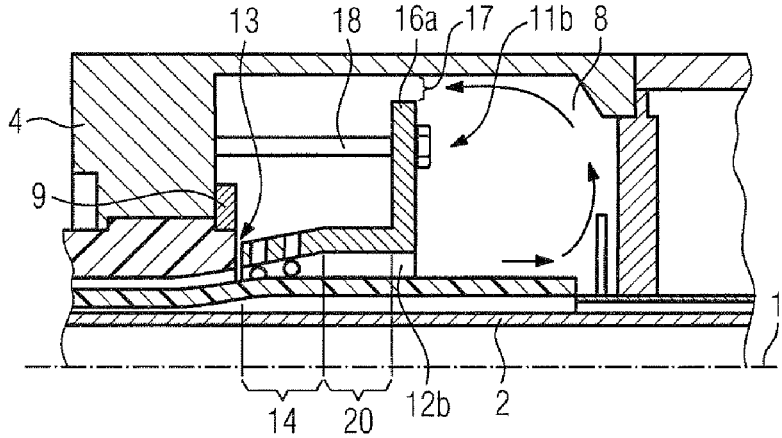

FIG. 3 shows a second refinement variant of a switching gas guide device 11*b* whose design principle is the same as that of the first variant of the switching gas guide device 11*a*. In the second variant of the switching gas guide device 11*b*, there is a hollow cylindrical section 20 adjacent to a hollow truncated conical section 14. The hollow cylindrical section 20 enlarges the section separated from the second variant of the flow guide device 11*b*, in order to keep cool insulating gas within the storage volume 8. A larger amount of cold insulating gas can therefore be kept in the storage volume 8. Furthermore, in the second variant of the flow guide device 11*b*, there is no arrangement of reverse-flow channels running radially within the projecting shoulder 16*a*. A reverse flow is therefore provided primarily via the annular gap 17 which is formed between an outer envelope surface of the projecting shoulder 16*a* and an inner envelope surface of the storage volume 8. This allows more specific separation of cold insulating gas and hot switching gas within the storage volume. However, a version with reverse-flow channels can also be provided, if required.

Figure 4:
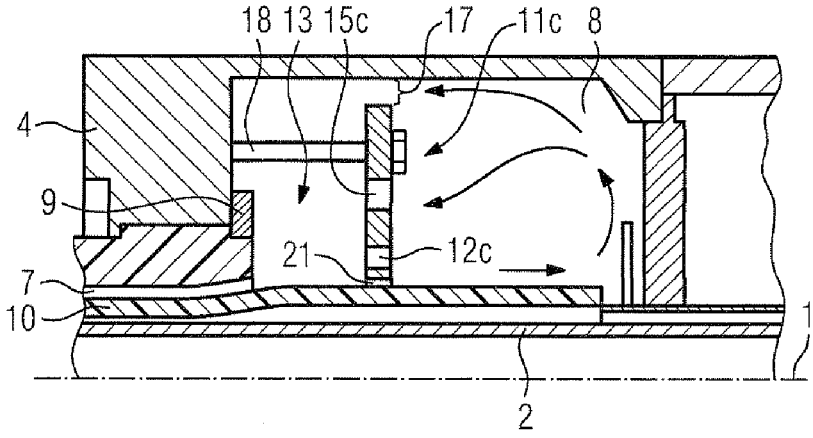

FIG. 4 shows a reduced third variant of a flow guide device 11*c*. The flow guide device 11*c* has a hollow cylindrical structure in the form of a disk. A switching gas inlet channel 12*c* passes through the hollow cylindrical disk and is in the form of a plurality of recesses, which are incorporated in the flow direction of the switching gas channel 7 into the flow inlet channel wall of the third variant of the flow guide device 11*c*.

In addition to a plurality of radially circumferentially distributed openings 12*c* in order to form a switching gas inlet channel, an annular gap 21 is formed between the switching gas inlet channel wall of the third variant of the flow guide device 11*c* and the auxiliary nozzle 10, likewise contributing to the formation of the switching gas inlet channel 12*c*. In the radial direction, the third refinement variant of the flow guide device 11*c* is surrounded by a plurality of reverse-flow channels 5*c* distributed on a circular path. An annular gap 17 is formed between an outer envelope surface of the third variant of the flow guide device 11*c* and an inner envelope surface of the storage volume 8. A configuration like an annular disk such as this for a flow guide device 11*c* has the advantage that it allows a flow barrier such as this to be manufactured at low cost.

Figure 5:
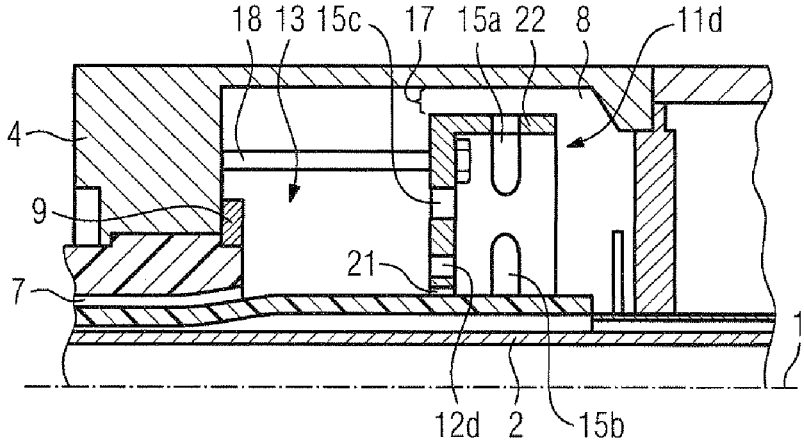

FIG. 5 shows a fourth variant of a flow guide device 11*d*. The fourth variant of a flow guide device 11*d* is based on the design of the third variant of a flow guide device 11*c*, as shown in FIG. 4. However, in this case, a projecting shoulder 22 is arranged on the outer circumference, with the projecting shoulder 22 extending substantially in the axial direction with respect to the longitudinal axis 1, or the emission direction of the switching gas channel 7. A plurality of reverse-flow channels 15*a*, 15*b* are incorporated in the projecting shoulder 22, are arranged distributed uniformly on the circumference and, on the fourth variant of the flow guide device 11*d* in the projecting shoulder, allow gases to overflow substantially in the radial direction.

Figure 6:
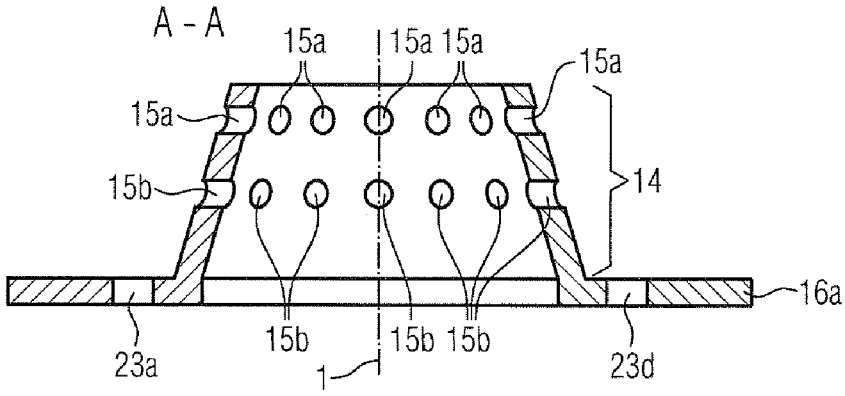
FIG. 6 shows a plan view of and a section through a flow guide device.
Figure 6:
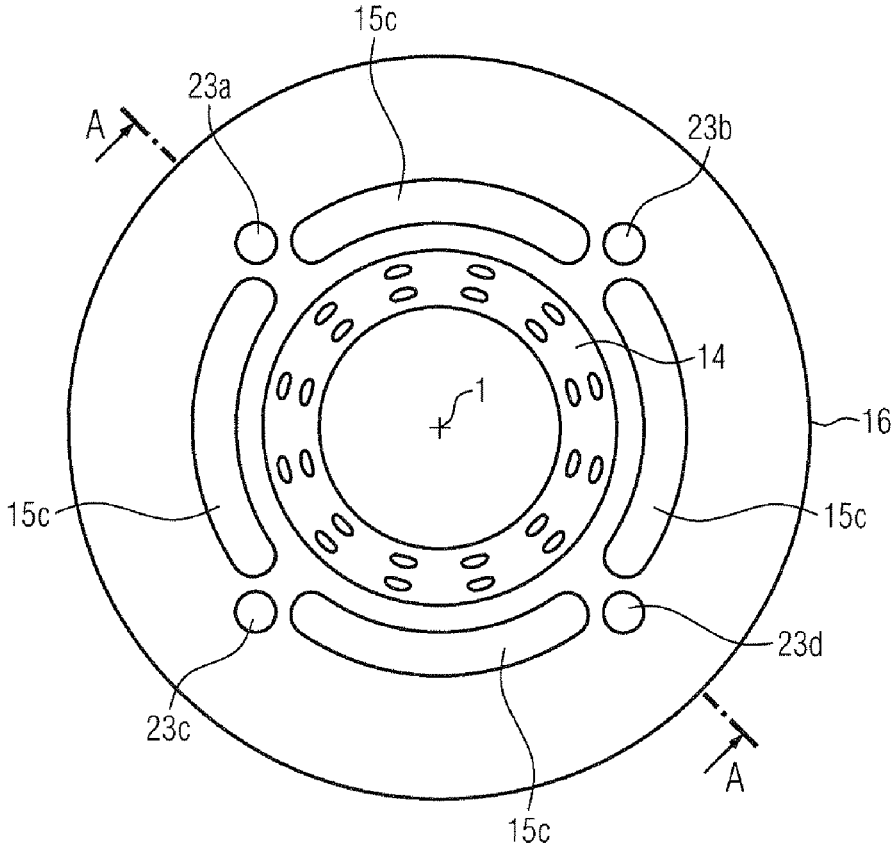

FIG. 6 shows the first variant of the flow guide device 11*a*, in the form of a section and a plan view. In the section, in particular, the figure shows the hollow truncated conical section 14 of the switching gas channel inlet wall, which is adjacent to the base surface of the projecting shoulder 16*a*. A plurality of mounting holes 23*a, b, c, d* are provided in the projecting shoulder 16*a*, and are used to hold stud bolts 18. A plurality of radially aligned reverse-flow channels 15*a*, 15*b* are arranged on two circular paths radially around the longitudinal axis 1. Furthermore, a plurality of reverse-flow channels 15*c*, which run in the emission direction, pass through the projecting shoulder 16. In this case, the reverse-flow channels 15*c* which run in the emission direction each have a cross section, which is curved in the form of a sector, in the form of a slot.

Because of the hollow truncated conical configuration of the section 14, the cross section of the inlet of the switching gas inlet channel 12*a* is smaller than the outlet of the switching gas inlet channel 12*a*.

In addition to various forms and configurations of the switching gas inlet channels 12*a*, 12*b*, 12*c*, 12*d* and various shapes of the flow guide device 11*a*, 11*b*, 11*c*, 11*d*, it is, however, considered to be advantageous for reverse-flow channels 15*a*, 15*b*, 15*c*, in addition to a switching gas inlet channel 12*a*, 12*b*, 12*c*, 12*d*, to pass through the flow guide device 11*a*, 11*b*, 11*c*, 11*d*, with an annular gap 13 being formed between a wall in which the switching gas channel 7 opens and the switching gas inlet channel wall.

The invention claimed is:

1. A high-voltage circuit breaker, comprising:

a storage volume;

an insulating material nozzle at least partially surrounding a switching gap of the circuit breaker, said insulating material nozzle being formed with a switching gas channel opening into said storage volume at an end surface of said insulating material nozzle;

a flow guide device disposed at least partially within said storage volume;

said flow guide device having a switching gas inlet channel wall bounding a switching gas inlet channel, said switching gas channel for injecting switching gas into said switching gas inlet channel in an emission direction and wherein an annular gap is formed between said end surface and said switching gas inlet channel wall.

2. The circuit breaker according to claim 1, wherein said switching gas inlet channel is an annular channel.

3. The circuit breaker according to claim 1, wherein said switching gas inlet channel has an inlet located upstream of an outlet in the emission direction, with said inlet having a cross section smaller than a cross section of the outlet.

4. The circuit breaker according to claim 1, wherein at least one reverse-flow channel is disposed in said switching gas inlet channel wall.

5. The circuit breaker according to claim 4, wherein said at least one reverse-flow channel is one of a plurality of reverse-flow channels in said switching gas inlet channel wall.

6. The circuit breaker according to claim 4, wherein at least one reverse-flow channel passes through a switching gas inlet channel wall in the emission direction.

7. The circuit breaker according to claim 4, wherein at least one reverse-flow channel passes through a switching gas inlet channel wall radially with respect to the emission direction.

8. The circuit breaker according to claim 1, wherein said switching gas inlet channel wall is formed with a projecting shoulder around said switching gas inlet channel.

9. The circuit breaker according to claim 8, wherein at least one reverse-flow channel passes through said projecting shoulder.

10. The circuit breaker according to claim 1, wherein a switching contact piece of the circuit breaker projects into said switching gas channel.

11. The circuit breaker according to claim 1, wherein an annular gap is formed between an outer envelope surface of said switching gas channel inlet wall and an inner envelope surface of said storage volume.

12. The circuit breaker according to claim 4, wherein said switching gas inlet channel wall has a hollow truncated conical section, and a reverse-flow channel passes through said section.

13. The circuit breaker according to claim 1, wherein said flow guide device is retained at a distance from walls of said storage volume via at least one stud bolt producing stressing forces running in a flow direction.

* * * * *